US005575406A

United States Patent [19]

Buchfink

[11] Patent Number: 5,575,406

[45] Date of Patent: Nov. 19, 1996

[54] BULK-MATERIAL SILO WITH EXPANSION CHAMBER

[75] Inventor: Adolf Buchfink, Rosengarten, Germany

[73] Assignee: Claudius Peters Aktiengesellschaft, Buxtehude, Germany

[21] Appl. No.: 367,159

[22] PCT Filed: May 11, 1994

[86] PCT No.: PCT/EP94/01535

§ 371 Date: Jan. 9, 1995

§ 102(e) Date: Jan. 9, 1995

[87] PCT Pub. No.: WO94/26629

PCT Pub. Date: Nov. 24, 1994

[30] Foreign Application Priority Data

May 14, 1993 [DE] Germany ..... 93 07 386.6 U

[51] Int. Cl.[6] ..... B65G 69/06

[52] U.S. Cl. ..... 222/195

[58] Field of Search ..... 222/185.1, 195

[56] References Cited

U.S. PATENT DOCUMENTS

| | | | |
|---|---|---|---|
| 4,236,852 | 12/1980 | Krauss | 406/90 |
| 4,382,723 | 5/1983 | Möller | 406/90 |
| 4,417,832 | 11/1983 | Kraus | 406/90 |
| 4,692,068 | 9/1987 | Hanrot et al. | 406/89 |

FOREIGN PATENT DOCUMENTS

| | | | |
|---|---|---|---|
| 0190082A1 | 8/1986 | European Pat. Off. | C25C 3/14 |
| 0400331A1 | 4/1990 | European Pat. Off. | B65D 88/72 |
| 2350288A1 | 12/1977 | France | B65G 65/72 |
| 1129892 | 5/1968 | Germany . | |
| 2073693 | 10/1981 | United Kingdom | B65G 53/04 |
| 2074549 | 11/1981 | United Kingdom | B65D 88/72 |

*Primary Examiner*—Gregory L. Huson
*Attorney, Agent, or Firm*—Chilton, Alix & Van Kirk

[57] ABSTRACT

A bulk-material silo has a silo draw-off opening which is located centrally in the ventilated silo base and is connected directly to an expansion chamber. The expansion chamber comprises two parts, the first of which leads outwardly in the manner of a duct from the silo draw-off opening towards and merging with the second part of the expansion chamber which is arranged outside the actual silo. Only said second part is configured with a sufficient height to permit the bulk material to fully expand during fluidization and with dust-extraction and draw-off devices. The air-extraction line from the upper silo space is fed, outside the silo, directly to the dust-extraction device.

3 Claims, 1 Drawing Sheet

BULK-MATERIAL SILO WITH EXPANSION CHAMBER

BACKGROUND OF THE INVENTION

In the case of bulk-material silos with base ventilation, the loosening air or a considerable part thereof has to escape through the silo draw-off opening together with the material. This results in a considerable pressure difference and high speeds prevailing at the draw-off opening. Non-uniform movement of the material within the silo may also result in a non-uniform draw-off. The resulting difficulties are controlled by using a so-called expansion chamber, this being a chamber which is of a considerable volume and considerable height and is provided directly downstream of the silo outflow opening. In this chamber, the material discharged out of the silo is relieved from the silo pressure and the excess air is led away before the material passes the draw-off members. The precondition for the expansion of, and air extraction from, the material is an expansion-chamber height which is greater than the height of expansion rise of the material which passes in the fluidized state out of the silo into the expansion chamber. The height of expansion rise is determined, in accordance with the principle of communicating pipes, by the pressure by which the material passes out of the silo into the expansion chamber. This height is usually in the region of from 4 m to 10 m. The column of material in the expansion chamber gives the excess air opportunity to escape, with the result that a level of material above which the excess air can be drawn off forms in the upper space of the expansion chamber. An important factor for the expansion action is that the expansion chamber follows on directly from the silo outflow opening, in order that the expansion takes effect directly at the silo outflow opening and that there is no counter-pressure, obstructing the outflow, as a result of high flow resistances. In the case of known configurations, this has resulted in the outflow chamber being arranged within the silo region in the main silo space (FR-A-2 350 288, GB-A-20 74 549) or beneath the silo base (EP-A-400 331). This requires a high degree of structural outlay.

SUMMARY OF THE INVENTION

The invention avoids these disadvantages by providing a silo for storing, fluidizing and discharging bulk material wherein the silo comprises a storage chamber having a ventilated base contoured to slope toward its center, a dual-stage expansion chamber, a dust extraction device and a storage chamber extraction line extending from the top of the storage chamber to the dust extraction device for conveying air therealong from the top of the storage chamber to the dust extraction device. The dual-stage expansion chamber has primary and secondary portions as well as an inlet for connecting the primary portion to the storage chamber at the center of its ventilated base. The secondary portion of the expansion chamber is positioned outside the storage chamber and the primary portion of the expansion chamber extends from the inlet toward and merging with the secondary portion. The expansion chamber includes a device for fluidizing the bulk material therein, while the secondary portion of the expansion chamber is provided with a height and volume in excess of that occupied by the fluidized bulk material, thereby providing a free space above the fluidized material. The dust extraction device is operatively connected with the free space for drawing off excess air and extracting dust therefrom. The base of the expansion chamber advantageously slopes downwardly toward a draw-off device that is operatively associated with the expansion chamber for receiving the bulk material therefrom. Preferably, the primary portion of the expansion chamber enlarges as it extends toward the secondary portion to provide space for expansion of the bulk material as it is fluidized.

Dividing the expansion chamber up into two parts can have the result that the expansion effect takes effect directly at the draw-off opening of the silo. It also has the effect that the part of the expansion chamber which is expensive due to its height is positioned in an easily accessible location outside the walls of the silo with the air-extraction and draw-off devices thereby facilitating inspection and maintenance. It is thus freed from the forces acting within the silo. The devices located downstream can be easily connected. Ready accessibility is ensured.

The feature of the first part of the expansion chamber merging directly into the second part means that no considerable flow resistance is present at this location, which flow resistance increases the pressure in the first part of the expansion chamber such that the expansion effect desired at the silo outflow opening is called into question.

The central arrangement of the silo outflow means that said arrangement is located at a distance from the outer limits of the silo, towards the center. A precisely central arrangement is not necessary, although it is often advantageous.

Expediently, the base of the expansion chamber slopes in order that, in the event of economical ventilation, no deposits form. Furthermore, it may be expedient if the first part of the chamber is designed to widen in the flow direction in order to provide space for the increasing expansion of the material.

In the case of known silos equipped with an expansion chamber, the draw-off of air is high in outlay because it has to be led from the upper chamber space to the upper silo space or to a draw-off line. The draw-off of the dust-charged air out of the upper silo space is also high in outlay because the air or the separated dust is passed on to a transporting path located downstream of the silo outflow, and, where there is more than one transporting path, selection has to be made of that path which is in operation in each case. This results in a high degree of extra expenditure in terms of machinery and control means. According to the invention, this is avoided in that the same dust-extraction devices are provided both for the air extraction from the expansion chamber and for the air extraction from the upper silo space and are expediently arranged in the vicinity of the expansion chamber since it is easier to lead the dust stream or dust/air stream from the level of the upper silo space downwards to the expansion chamber than vice versa. In many cases, preliminary dust extraction (for example by means of a cyclone) in the silo can be fully dispensed with.

This is particularly expedient in the case of such types of silo construction which are delimited at the top by a cupola or, for other reasons, render the attachment of dust-extraction devices difficult.

The invention is explained in more detail hereinbelow with reference to the drawing which schematically illustrates an advantageous exemplary embodiment and in which:

DETAILED DESCRIPTION of a PREFERRED EMBODIMENT

Figure 1:
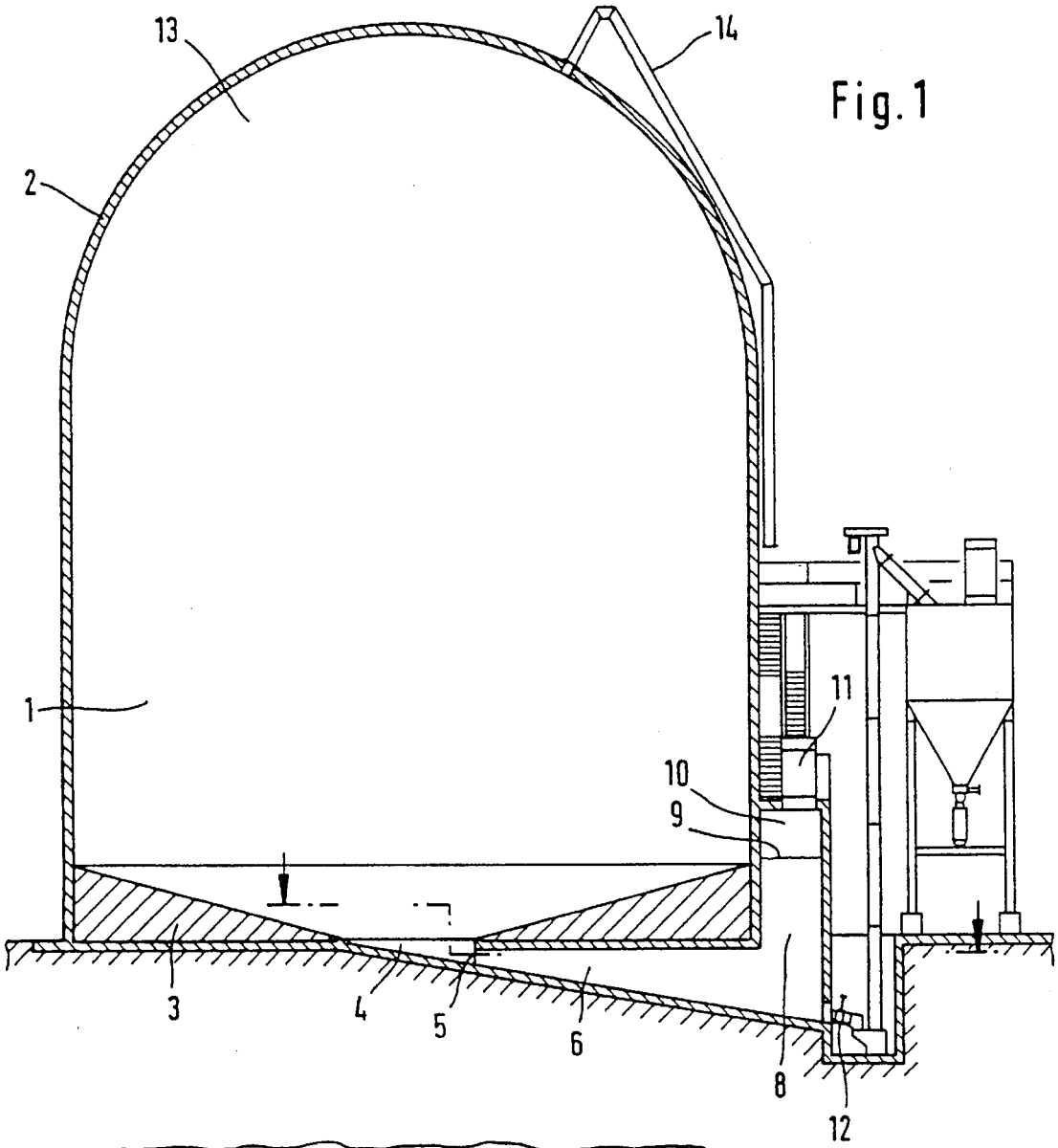
FIG. 1 shows a vertical section.
Figure 2:
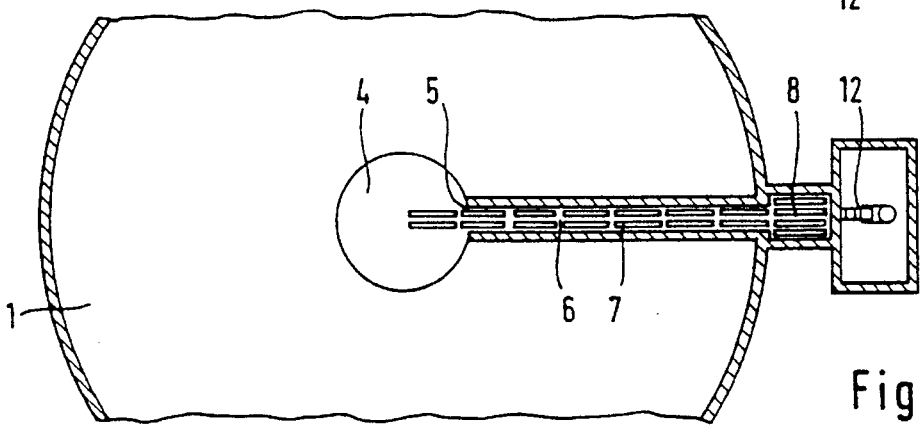
FIG. 2 shows a horizontal section.

The silo 1, which has a diameter in the order of magnitude of 20–40 m, is closed at the top by a cupola 2. Its ventilated base 3, which is configured to slope towards the center, is seated on the natural soil. Provided in the center is an outflow depression 4 which, at 5, forms the actual outflow opening, namely the narrow point, behind which the first part 6 of the expansion chamber is located. Said first part widens from the silo outflow opening 5 in order to provide space for the expansion of the material. Consequently, an acceleration with build-up of counter-pressure is avoided and the expansion action takes effect at the silo outflow opening 5 although the expansion chamber does not widen sharply behind the outflow opening.

The first part 6 of the expansion chamber, which expediently runs beneath the silo base, merges directly into the second part 8 of the expansion chamber, which is designed as a vertical shaft which is cross-sectionally widened to a small extent with respect to the first part. In said shaft, the fluidized material rises to the level 9, which is located at a lower point than the upper limit of the expansion chamber, with the result that a space 10 which is essentially free of material is formed above said level 9, it being possible for the excess air to be drawn off out of said space towards the dust-extraction device 11.

The base of the expansion chamber slopes and is equipped with ventilating devices 7. It runs towards the draw-off devices 12, from which the material is conveyed away in a known manner.

In so far as the loosening air supplied in the silo is not led away through the silo outflow opening 5 with the material, it passes into the upper silo space 13, from where it is led down through the line 14 by gravity, without interim dust extraction, to the dust-extraction device 11.

The first duct-like part 6 of the expansion chamber expediently runs beneath the silo base or beneath a base installation of the silo.

I claim:

1. A silo for storing, fluidizing and discharging bulk material comprising a storage chamber having a ventilated base contoured to slope toward its center, a dual stage expansion chamber having primary and secondary expansion portions and an inlet for connecting the primary portion to the storage chamber at the center of the base, the secondary portion of the expansion chamber being positioned outside the storage chamber and the primary portion of the expansion chamber extending from the inlet of the expansion chamber toward and merging with the secondary portion, said expansion chamber having means for fluidizing the bulk material therein and said secondary portion having a volume in excess of that occupied by the fluidized bulk material to provide a free space above the fluidized material, dust extraction means operatively communicating with said free space for drawing off excess air from said space and extracting dust therefrom and a storage chamber air extraction line extending from the top of the storage chamber and operatively communicating with the dust extraction means for conveying air therealong from the top of the storage chamber toward the dust extraction means.

2. The bulk-material silo according to claim 1, including a draw-off device operatively associated with the expansion chamber for receiving the bulk material therefrom, the expansion chamber having a base that slopes down to the draw-off device.

3. The bulk-material silo according to claim 1 wherein the primary portion (6) of the expansion chamber enlarges as it extends toward the secondary portion to provide space for expansion of the material as it is fluidized.

* * * * *